US009607732B2

(12) United States Patent
Han et al.

(10) Patent No.: US 9,607,732 B2
(45) Date of Patent: Mar. 28, 2017

(54) POLYMERIC COATINGS FOR COATED CONDUCTORS

(71) Applicant: DOW GLOBAL TECHNOLOGIES LLC, Midland, MI (US)

(72) Inventors: Suh Joon Han, Schwenksville, PA (US); Suzanne M. Guerra, Lake Jackson, TX (US); Jeffrey M. Cogen, Flemington, NJ (US); Gary R. Marchand, Gonzales, LA (US); Jerker B. L. Kjellqvist, Waedenswil (CH)

(73) Assignee: Dow Global Technologies LLC

( * ) Notice: Subject to any disclaimer, the term of this patent is extended or adjusted under 35 U.S.C. 154(b) by 11 days.

(21) Appl. No.: 14/397,385

(22) PCT Filed: May 15, 2013

(86) PCT No.: PCT/US2013/041053

§ 371 (c)(1),
(2) Date: Oct. 27, 2014

(87) PCT Pub. No.: WO2014/003908

PCT Pub. Date: Jan. 3, 2014

(65) Prior Publication Data

US 2015/0122529 A1 May 7, 2015

Related U.S. Application Data

(60) Provisional application No. 61/664,779, filed on Jun. 27, 2012.

(51) Int. Cl.

| | |
|---|---|
| ***H01B 7/00*** | (2006.01) |
| ***H01B 3/44*** | (2006.01) |
| ***H01B 7/28*** | (2006.01) |

(52) U.S. Cl.
CPC ..... *H01B 3/441* (2013.01); *H01B 7/2813* (2013.01)

(58) Field of Classification Search
CPC ... H01B 3/30; H01B 3/32; H01B 3/42; H01B 3/421
USPC ..... 174/110 R, 110 A–110 E, 36, 113 R, 174/117 R
See application file for complete search history.

(56) References Cited

U.S. PATENT DOCUMENTS

| | | | |
|---|---|---|---|
| 4,101,498 A | 7/1978 | Snyder | |
| 4,303,574 A | 12/1981 | Vostovich | |
| 4,305,849 A | 12/1981 | Kawasaki et al. | |
| 4,452,937 A | 6/1984 | Keogh | |

(Continued)

FOREIGN PATENT DOCUMENTS

| | | | |
|---|---|---|---|
| EP | 1 221 464 A * | 1/2001 | ..... C08L 53/00 |
| WO | 2005/090426 A1 | 9/2005 | |
| WO | 2009012215 A1 | 1/2009 | |

OTHER PUBLICATIONS

PCT/US2013/041053, mailed Sep. 26, 2013; International Search Report and Written Opinion of the International Searching Authority.

(Continued)

*Primary Examiner* — William H Mayo, III

(57) ABSTRACT

Coated conductors including a conductive core at least partially surrounded by a polymeric coating. The polymeric coating has an α-olefin based polymer and an α-olefin based block composite. The α-olefin block composite has block copolymers having hard segments and soft segments.

10 Claims, 4 Drawing Sheets

(56) References Cited

U.S. PATENT DOCUMENTS

| | | | | |
|---|---|---|---|---|
| 4,853,154 | A * | 8/1989 | Icenogle | C08F 287/00 106/18.26 |
| 4,857,600 | A | 8/1989 | Gross et al. | |
| 4,876,147 | A | 10/1989 | Schlag et al. | |
| 5,011,736 | A | 4/1991 | Abolins et al. | |
| 5,180,889 | A | 1/1993 | Rogers et al. | |
| 5,246,783 | A | 9/1993 | Spenadel et al. | |
| 5,575,965 | A | 11/1996 | Caronia et al. | |
| 5,919,983 | A | 7/1999 | Rosen et al. | |
| 6,200,679 | B1 * | 3/2001 | Hase | C09K 21/14 174/110 PM |
| 6,203,907 | B1 | 3/2001 | Keogh | |
| 6,452,106 | B1 * | 9/2002 | Hase | H01B 3/441 174/110 R |
| 6,475,628 | B2 * | 11/2002 | Hase | C08L 23/10 174/110 R |
| 6,496,629 | B2 | 12/2002 | Ma et al. | |
| 6,714,707 | B2 | 3/2004 | Rossi et al. | |
| 7,355,089 | B2 | 4/2008 | Chang et al. | |
| 2002/0011347 | A1 | 1/2002 | Sato et al. | |
| 2002/0142175 | A1 | 10/2002 | Hase et al. | |
| 2006/0199930 | A1 | 9/2006 | Li Pi Shan et al. | |
| 2007/0167578 | A1 | 7/2007 | Arriola et al. | |
| 2008/0269412 | A1 | 10/2008 | Carnahan et al. | |
| 2008/0311812 | A1 | 12/2008 | Arriola et al. | |
| 2010/0212930 | A1 * | 8/2010 | Yasumoto | C08K 3/22 174/110 SR |
| 2011/0082258 | A1 | 4/2011 | Walton et al. | |
| 2011/0308836 | A1 * | 12/2011 | Liu | H01B 3/442 174/110 SR |
| 2012/0145434 | A1 * | 6/2012 | Kambe | C08L 23/10 174/110 SR |
| 2012/0279753 | A1 * | 11/2012 | Kambe | C08L 23/10 174/110 SR |

OTHER PUBLICATIONS

PCT/US2013/041053, mailed Jan. 8, 2015 International Preliminary Report on Patentability.

Dow Global Technologies LLC EP Appln. No. 13728268.7-1302, Rejection dated Feb. 3, 2015.

* cited by examiner

POLYMERIC COATINGS FOR COATED CONDUCTORS

REFERENCE TO RELATED APPLICATIONS

The present application claims the benefit of U.S. Provisional Application No. 61/664,779, filed on Jun. 27, 2012.

FIELD

Various embodiments of the present invention relate to polymeric coatings for coated conductors. Such polymeric coatings comprise a α-olefin block composite and an α-olefin based polymer. The polymeric coating at least partially surrounds a conductor.

INTRODUCTION

Power delivery products (e.g., power cables) and accessories (e.g., joint, termination, and other solid dielectric components) experience ingress of moisture when employed underground or in submarine condition. Water, which is usually present at 100% relative humidity at typical one-meter burial depths, can penetrate through polymeric layers of such products over time.

Over years of service in a wet condition, power cables and other cable components degrade due to water treeing, which creates physical voids in the polymeric insulation and regions of chemically changed polymer that support higher water solubility than virgin polyethylene. The electromechanical mechanism for water treeing is based on the mechanical force induced by electrical stress on the molecules or ions, which cause pressure and cracking or fatigue-type damage. Additionally, water treeing can result from chemical processes, such as oxidation. Accordingly, water treeing does not obey a single mechanism, but rather a complex combination of various mechanisms.

Although advancements have been made, improvements are needed in the art for power cables and components having resistance to water treeing.

SUMMARY

One embodiment is a coated conductor comprising:

a conductive core; and a polymeric coating at least partially surrounding said conductive core, wherein said polymeric coating comprises an α-olefin based polymer and an α-olefin block composite.

DETAILED DESCRIPTION

Figure 1:
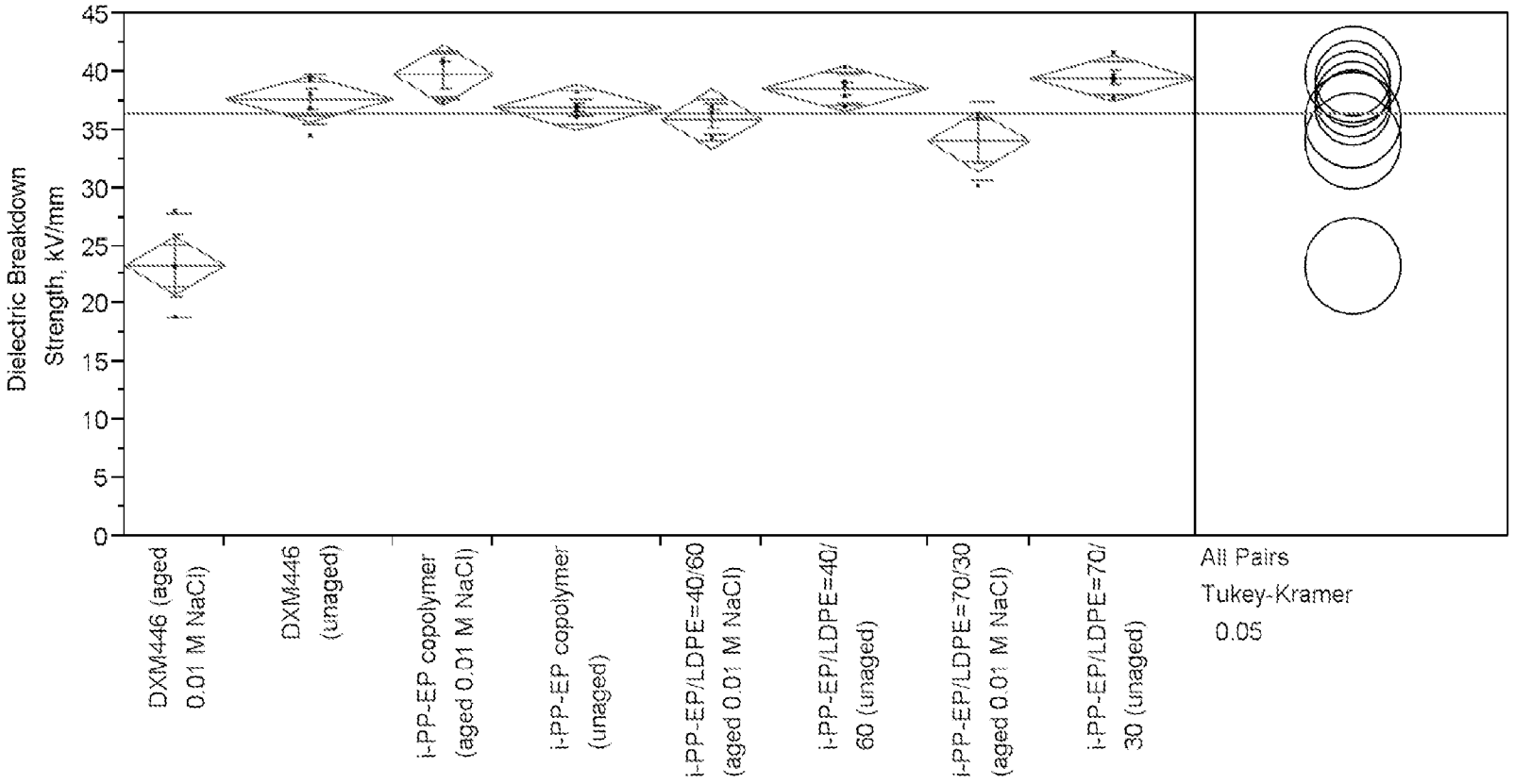
FIG. 1 is a chart of dielectric breakdown strength for samples prepared in Example 1, specifically dielectric breakdown performance before and after aging in 0.01 M NaCl.

Various embodiments of the present invention concern a coated conductor comprising a conductive core at least partially surrounded by a polymeric coating. The polymeric coating comprises an α-olefin based polymer and an α-olefin block composite. The block composite comprises diblock copolymers having a "hard" polymer segment and a "soft" copolymer segment, as described below.

Composition of Polymeric Coating

Initially, the polymeric coating comprises an α-olefin based polymer. As used herein, the term "α-olefin based polymer" denotes a polymer that comprises a majority weight percent ("wt %") of polymerized α-olefin monomer, based on the total weight of polymerizable monomers, and optionally may comprise at least one polymerized comonomer. Comonomers may be other α-olefin monomers or non-α-olefin monomers. The α-olefin based polymer may include greater than 50, at least 60, at least 70, at least 80, or at least 90 wt % units derived from an α-olefin monomer, based on the total weight of the α-olefin based polymer. The α-olefin based polymer may be a Ziegler-Natta catalyzed polymer, a metallocene-catalyzed polymer, and/or a constrained geometry catalyst catalyzed polymer. Additionally, the α-olefin based polymers may be made using gas phase, solution, or slurry polymer manufacturing processes.

Suitable types of α-olefin monomers include, but are not limited to, $C_{2-20}$ (i.e., having 2 to 20 carbon atoms) linear, branched or cyclic α-olefins. Non-limiting examples of suitable $C_{2-20}$ α-olefins include ethylene, propylene, 1-butene, butadiene, isoprene, 4-methyl-1-pentene, 1-hexene, 1-octene, 1-decene, 1-dodecene, 1-tetradecene, 1-hexadecene, and 1-octadecene. The α-olefins also can contain a cyclic structure such as cyclohexane or cyclopentane, resulting in an α-olefin such as 3-cyclohexyl-1-propene (allyl cyclohexane) and vinyl cyclohexane. The α-olefin based polymer can further comprise halogenated groups, such as chlorine, bromine, and fluorine.

In various embodiments, the α-olefin based polymer can be an interpolymer of ethylene and one or more comonomers. Illustrative interpolymers include ethylene/propylene, ethylene/butene, ethylene/1-hexene, ethylene/1-octene, ethylene/styrene, ethylene/propylene/1-octene, ethylene/propylene/butene, ethylene/butene/1-octene, ethylene/propylene/diene monomer ("EPDM") and ethylene/butene/styrene. The interpolymers can be random interpolymers.

In an embodiment, the α-olefin based polymer comprises polyethylene homopolymer. As used herein, the term "homopolymer" denotes a polymer comprising repeating units derived from a single monomer type, but does not exclude residual amounts of other components used in preparing the homopolymer, such as chain transfer agents.

In an embodiment, the α-olefin based polymer can be a low density polyethylene ("LDPE"). As used herein, the term low density polyethylene denotes an ethylene-based polymer having a density range from 0.910 to 0.930 g/cm$^3$, as determined by ASTM D792. Relative to high density polyethylene, LDPE has a high degree of short chain branching and/or a high degree of long chain branching.

In an embodiment, the LDPE can have a peak melting temperature of at least 105° C., or at least 110° C., up to 115° C., or 125° C. The LDPE can have a melt index ("$I_2$") from 0.5 g/10 min, or 1.0 g/10 min, or 1.5 g/10 min, or 2.0 g/10 min, up to 10.0 g/10 min, or 8.0 g/10 min, or 6.0 g/10 min, or 5.0 g/10 min, or 3.0 g/10 min, as determined according to ASTM D-1238 (190° C./2.16 kg). Also, the LDPE can have a polydispersity index ("PDI") (i.e., weight average molecular weight/number average molecular weight; "Mw/Mn;" or molecular weight distribution ("MWD")) in the range of from 1.0 to 30.0, or in the range of from 2.0 to 15.0, as determined by gel permeation chromatography.

In an embodiment, the LDPE is a linear low density polyethylene.

In various embodiments, the α-olefin based polymer can be a high density polyethylene. The term "high density polyethylene" ("HDPE") denotes an ethylene-based polymer having a density greater than or equal to 0.941 g/cm$^3$. In an embodiment, the HDPE has a density from 0.945 to 0.97 g/cm$^3$, as determined according to ASTM D-792. The HDPE can have a peak melting temperature of at least 130° C., or from 132 to 134° C. The HDPE can have an $I_2$ from 0.1 g/10 min, or 0.2 g/10 min, or 0.3 g/10 min, or 0.4 g/10 min, up to 5.0 g/10 min, or 4.0 g/10 min, or, 3.0 g/10 min or 2.0 g/10 min, or 1.0 g/10 min, or 0.5 g/10 min, as determined according to ASTM D-1238 (190° C./2.16 kg). Also, the HDPE can have a PDI in the range of from 1.0 to 30.0, or in the range of from 2.0 to 15.0, as determined by gel permeation chromatography.

In various embodiments, the α-olefin based polymer can be an ethylene-propylene rubber ("EPR") or ethylene-propylene-diene monomer ("EPDM") polymer. The EPR or EPDM polymer can have a peak melting temperature of at least 130° C., or alternatively, a peak melting temperature from −40 to 100° C. The EPR or EPDM polymer can have an $I_2$ from 0.10 g/10 min or 5.0 g/10 min, to 20.0 g/10 min, or 100 g/10 min, as determined according to ASTM D-1238 (190° C./2.16 kg). Also, the EPR or EPDM polymer can have a PDI in the range of from 1.0 to 30.0, or in the range of from 2.0 to 15.0, as determined by gel permeation chromatography.

In various embodiments, the α-olefin based polymer can be a polypropylene. The polypropylene can have a peak melting temperature in the range of 150 to 170° C. The polypropylene can have an $I_2$ from 0.1.0 g/10 min or 5.0 g/10 min, to 20.0 g/10 min, or 100 g/10 min, as determined according to ASTM D-1238 (190° C./2.16 kg). Also, the polypropylene polymer can have a PDI in the range of from 1.0 to 30.0, or in the range of from 2.0 to 15.0, as determined by gel permeation chromatography.

As noted above, in addition to the α-olefin based polymer, the polymeric coating comprises a block composite. The term "block composite" refers to polymers comprising a soft copolymer, a hard polymer and a block copolymer having a soft segment and a hard segment, where the hard segment of the block copolymer is the same composition as the hard polymer in the block composite and the soft segment of the block copolymer is the same composition as the soft copolymer of the block composite. The block copolymers can be linear or branched. More specifically, when produced in a continuous process, the block composites can have a PDI from 1.7 to 15, from 1.8 to 3.5, from 1.8 to 2.2, or from 1.8 to 2.1. When produced in a batch or semi-batch process, the block composites can have a PDI from 1.0 to 2.9, from 1.3 to 2.5, from 1.4 to 2.0, or from 1.4 to 1.8. In an embodiment, the block composite can be an α-olefin block composite. The term "α-olefin block composite" refers to block composites prepared solely or substantially solely from two or more α-olefin types of monomers. In various embodiments, the α-olefin block composite can consist of only two α-olefin type monomer units. An example of an α-olefin block composite would be a hard segment and hard polymer comprising only or substantially only propylene monomer residues with a soft segment and soft polymer comprising only or substantially only ethylene and propylene comonomer residues.

As used herein, "hard" segments refer to highly crystalline blocks of polymerized units in which a single monomer is present in an amount greater than 95 mole percent ("mol %"), or greater than 98 mol %. In other words, the comonomer content in the hard segments is less than 5 mol %, or less than 2 mol %. In some embodiments, the hard segments comprise all or substantially all propylene units. "Soft" segments, on the other hand, refer to amorphous, substantially amorphous or elastomeric blocks of polymerized units having a comonomer content greater than 10 mol %. In some embodiments, the soft segments comprise ethylene/propylene interpolymers.

When referring to block composites, the term "polyethylene" includes homopolymers of ethylene and copolymers of ethylene and one or more $C_{3-8}$ α-olefins in which ethylene comprises at least 50 mole percent. The term "propylene copolymer" or "propylene interpolymer" means a copolymer comprising propylene and one or more copolymerizable comonomers, where a plurality of the polymerized monomer units of at least one block or segment in the polymer (the crystalline block) comprises propylene, which can be present in an amount of at least 90 mole percent, at least 95 mole percent, or at least 98 mole percent. A polymer made primarily from a different α-olefin, such as 4-methyl-1-pentene would be named similarly. The term "crystalline" refers to a polymer or polymer block that possesses a first order transition or crystalline melting point ("Tm") as determined by differential scanning calorimetry ("DSC") or equivalent technique. The term "crystalline" may be used interchangeably with the term "semicrystalline." The term "amorphous" refers to a polymer lacking a crystalline melting point. The term, "isotactic" denotes polymer repeat units having at least 70 percent isotactic pentads as determined by $^{13}$C-nulcear magnetic resonance ("NMR") analysis. "Highly isotactic" denotes polymers having at least 90 percent isotactic pentads.

The term "block copolymer" or "segmented copolymer" refers to a polymer comprising two or more chemically distinct regions or segments (referred to as "blocks") joined in a linear manner, that is, a polymer comprising chemically differentiated units which are joined end-to-end with respect to polymerized ethylenic functionality, rather than in pendent or grafted fashion. In an embodiment, the blocks differ in the amount or type of comonomer incorporated therein, the density, the amount of crystallinity, the crystallite size attributable to a polymer of such composition, the type or degree of tacticity (isotactic or syndiotactic), regio-regularity or regio-irregularity, the amount of branching, including long chain branching or hyper-branching, the homogeneity, or any other chemical or physical property. The block copolymers of the invention are characterized by unique distributions of polymer PDI, block length distribution, and/or block number distribution, due, in a preferred embodiment, to the effect of shuttling agent(s) in combination with the catalyst(s) used in preparing the block composites.

The block composite employed herein can be prepared by a process comprising contacting an addition polymerizable monomer or mixture of monomers under addition polymerization conditions with a composition comprising at least one addition polymerization catalyst, a cocatalyst and a chain shuttling agent ("CSA"), the process being characterized by formation of at least some of the growing polymer chains under differentiated process conditions in two or more reactors operating under steady state polymerization conditions or in two or more zones of a reactor operating under plug flow polymerization conditions.

Suitable monomers for use in preparing the block composites of the present invention include any addition polymerizable monomer, such as any olefin or diolefin monomer, including any α-olefin. Examples of suitable monomers include straight-chain or branched α-olefins of 2 to 30, or 2 to 20, carbon atoms, such as ethylene, propylene, 1-butene, 1-pentene, 3-methyl-1-butene, 1-hexene, 4-methyl-1-pentene, 3-methyl-1-pentene, 1-octene, 1-decene, 1-dodecene, 1-tetradecene, 1-hexadecene, 1-octadecene and 1-eicosene; and di- and poly-olefins, such as butadiene, isoprene, 4-methyl-1,3-pentadiene, 1,3-pentadiene, 1,4-pentadiene, 1,5-hexadiene, 1,4-hexadiene, 1,3-hexadiene, 1,3-octadiene, 1,4-octadiene, 1,5-octadiene, 1,6-octadiene, 1,7-octadiene, ethylidene norbornene, vinyl norbornene, dicyclopentadiene, 7-methyl-1,6-octadiene, 4-ethylidene-8-methyl-1,7-nonadiene, and 5,9-dimethyl-1,4,8-decatriene. In various embodiments, ethylene and at least one copolymerizable comonomer, propylene and at least one copolymerizable comonomer having from 4 to 20 carbons, 1-butene and at least one copolymerizable comonomer having 2 or from 5 to 20 carbons, or 4-methyl-1-pentene and at least one different copolymerizable comonomer having from 4 to 20 carbons can be employed. In an embodiment, the block composites are prepared using propylene and ethylene monomer.

Comonomer content in the resulting block composites may be measured using any suitable technique, such as NMR spectroscopy. It is highly desirable that some or all of the polymer blocks comprise amorphous or relatively amorphous polymers such as copolymers of propylene, 1-butene, or 4-methyl-1-pentene and a comonomer, especially random copolymers of propylene, 1-butene, or 4-methyl-1-pentene with ethylene, and any remaining polymer blocks (hard segments), if any, predominantly comprise propylene, 1-butene or 4-methyl-1-pentene in polymerized form. Preferably such hard segments are highly crystalline or stereospecific polypropylene, polybutene or poly-4-methyl-1-pentene, especially isotactic homopolymers.

Further, the block copolymers of the block composites comprise from 10 to 90 wt % hard segments and 90 to 10 wt % soft segments.

Within the soft segments, the mole percent comonomer may range from 5 to 90 wt %, or from 10 to 60 wt %. In the case where the comonomer is ethylene, it can be present in an amount from 10 to 75 wt %, or from 30 to 70 wt %. In an embodiment, propylene constitutes the remainder of the soft segment.

In an embodiment, the block copolymers of the block composites comprise hard segments that are 80 to 100 wt % propylene. The hard segments can be greater than 90 wt %, 95 wt %, or 98 wt % propylene.

The block composites described herein may be differentiated from conventional, random copolymers, physical blends of polymers, and block copolymers prepared via sequential monomer addition. The block composites may be differentiated from random copolymers by characteristics such as higher melting temperatures for a comparable amount of comonomer, block composite index, as described below; from a physical blend by characteristics such as block composite index, better tensile strength, improved fracture strength, finer morphology, improved optics, and greater impact strength at lower temperature; from block copolymers prepared by sequential monomer addition by molecular weight distribution, rheology, shear thinning, rheology ratio, and in that there is block polydispersity.

In some embodiments, the block composites have a Block Composite Index ("BCI"), as defined below, that is greater than zero but less than 0.4, or from 0.1 to 0.3. In other embodiments, BCI is greater than 0.4 and up to 1.0. Additionally, the BCI can range from 0.4 to 0.7, from 0.5 to 0.7, or from 0.6 to 0.9. In some embodiments, BCI ranges from 0.3 to 0.9, from 0.3 to 0.8, from 0.3 to 0.7, from 0.3 to 0.6, from 0.3 to 0.5, or from 0.3 to 0.4. In other embodiments, BCI ranges from 0.4 to 1.0, from 0.5 to 1.0, from 0.6 to 1.0, from 0.7 to 1.0, from 0.8 to 1.0, or from 0.9 to 1.0. BCI is herein defined to equal the weight percentage of diblock copolymer divided by 100% (i.e., weight fraction). The value of the block composite index can range from 0 to 1, wherein 1 would be equal to 100% inventive diblock and zero would be for a material such as a traditional blend or random copolymer. Methods for determining BCI can be found, for example, in U.S. Published Patent Application No. 2011/0082258 from paragraph [0170] to [0189].

The block composites can have a Tm greater than 100° C., preferably greater than 120° C., and more preferably greater than 125° C. The melt flow rate ("MFR") (230° C., 2.16 kg) of the block composite can range from 0.1 to 1000 dg/min, from 0.1 to 50 dg/min, from 0.1 to 30 dg/min, or from 1 to 10 dg/min. The block composites can have a weight average molecular weight ("Mw") from 10,000 to 2,500,000, from 35,000 to 1,000,000, from 50,000 to 300,000, or from 50,000 to 200,000 g/mol.

Suitable processes useful in producing the block composites of the invention may be found, for example, in US Patent Application Publication No. 2008/0269412, published on Oct. 30, 2008. Suitable catalysts and catalyst precursors for use in the present invention include metal complexes such as disclosed in WO2005/090426, in particular, those disclosed starting on page 20, line 30 through page 53, line 20. Suitable catalysts are also disclosed in U.S. 2006/0199930; U.S. 2007/0167578; U.S. 2008/0311812; U.S. 2011/0082258; U.S. Pat. No. 7,355,089; or WO 2009/012215. Suitable co-catalysts are those disclosed in WO2005/090426, in particular, those disclosed on page 54, line 1 to page 60, line 12. Suitable chain shuttling agents are those disclosed in WO2005/090426, in particular, those disclosed on page 19, line 21 through page 20 line 12. Particularly preferred chain shuttling agents are dialkyl zinc compounds.

Preparation of Polymeric Coating

In various embodiments, the above-described α-olefin based polymer and block composite can be blended to create polymer coatings (e.g., insulation and/or jackets) for wires and/or cables. The α-olefin based polymer can be present in the blend in an amount of at least 10 wt %, at least 20 wt %, at least 30 wt %, or at least 40 wt %, up to 90 wt %, 80 wt %, 70 wt %, or 60 wt %, based on the combined weight of the α-olefin based polymer and the block composite. The block composite can be present in the blend in an amount of at least 10 wt %, at least 20 wt %, at least 30 wt %, or at least 40 wt %, up to 90 wt %, 80 wt %, 70 wt %, or 60 wt %, based on the combined weight of the α-olefin based polymer and the block composite.

When employed in such articles of manufacture, the blend may contain other additives including, but not limited to, organic peroxides, processing aids, fillers, coupling agents, ultraviolet absorbers or stabilizers, antistatic agents, nucleating agents, slip agents, plasticizers, lubricants, viscosity control agents, tackifiers, anti-blocking agents, surfactants, extender oils, acid scavengers, flame retardants, moisture cure catalysts, vinyl alkoxysilane, and metal deactivators. Additives, other than fillers, are typically used in amounts ranging from 0.01 or less to 10 or more wt % based on total composition weight. Fillers are generally added in larger amounts although the amount can range from as low as 0.01 or less to 65 or more wt % based on the weight of the composition. Illustrative examples of fillers include clays, precipitated silica and silicates, fumed silica, calcium carbonate, titanium dioxide, magnesium oxide, metal oxides, ground minerals, aluminum trihydroxide, magnesium hydroxide, and carbon blacks with typical arithmetic mean particle sizes larger than 15 nanometers.

Additionally, an antioxidant can be employed with the polymeric coating. Exemplary antioxidants include hindered phenols (e.g., tetrakis[methylene (3,5-di-t-butyl-4-hydroxyhydrocinnamate)]methane); phosphites and phosphonites (e.g., tris(2,4-di-t-butylphenyl)phosphate); thio compounds (e.g., dilaurylthiodipropionate); various siloxanes; and various amines (e.g., polymerized 2,2,4-trimethyl-1,2-dihydroquinoline). Antioxidants can be used in amounts of 0.1 to 5 wt % based on the total composition weight of the polymeric coating material.

An unexpected benefit of the present composition is its ability to mitigate water treeing without employing a water tree retarding additive. Accordingly, in various embodiments, the polymeric coating comprises no or substantially no water tree retarding additives. As used herein, the term "substantially no" shall denote a concentration of less than 10 parts per million ("ppm") based on the entire polymeric coating weight. In an embodiment, the polymeric coating comprises no or substantially no polyethylene glycol.

Compounding of the polymeric coating can be effected by standard equipment known to those skilled in the art. Examples of compounding equipment are internal batch mixers, such as a Banbury™ or Bolling™ internal mixer. Alternatively, continuous single, or twin screw, mixers can be used, such as a Farrel™ continuous mixer, a Werner and Pfleiderer™ twin screw mixer, or a Buss™ kneading continuous extruder.

The blended polymeric coating can have a wet aged dielectric breakdown of at least 25 kV/mm, at least 30 kV/mm, or at least 35 kV/mm. In various embodiments, the blended polymeric coating can have a wet aged dielectric breakdown in the range of from 25 to 45 kV/mm, in the range of from 30 to 40 kV/mm, or in the range of from 35 to 40 kV/mm. Dielectric breakdown is determined according to ASTM D149-09. Wet aging is performed according to the procedure described in the following examples, determined using 0.01, 1.0, or 3.5 M sodium chloride ("NaCl") aqueous solution for 21 days. Though not wishing to be bound by theory, it is thought that the unique phase morphology of the block composite imposes torturous paths for electric degradation in the given accelerated wet aging condition, which retards wet aging degradation. In an embodiment, the blended polymeric coating can have a breakdown strength retention of at least 70%, at least 80%, at least 90%, at least 95%, or at least 98%, upon wet aging in 3.5 M NaCl aqueous solution for 21 days, as determined on plaques having a thickness of 40 mils and a 2-inch diameter according to ASTM D149-09.

Coated Conductor

In various embodiments, a cable comprising a conductor and an insulation layer can be prepared employing the above-described polymeric coating blend. A cable containing an insulation layer comprising the polymeric coating blend can be prepared with various types of extruders (e.g., single or twin screw types). A description of a conventional extruder can be found in U.S. Pat. No. 4,857,600. An example of co-extrusion and an extruder therefore can be found in U.S. Pat. No. 5,575,965.

Following extrusion, the extruded intermediate cable can pass into a heated cure zone downstream of the extrusion die to aid in cross-linking the polymeric coating in the presence of a cross-linking catalyst. The heated cure zone can be maintained at a temperature in the range of 175 to 260° C. The heated zone can be heated by pressurized steam or inductively heated by pressurized nitrogen gas.

Alternating current cables prepared according to the present disclosure can be low voltage, medium voltage, high voltage, or extra-high voltage cables. Further, direct current cables prepared according to the present disclosure include high or extra-high voltage cables.

DEFINITIONS

"Wire" means a single strand of conductive metal, e.g., copper or aluminum, or a single strand of optical fiber.

"Cable" and "power cable" mean at least one wire or optical fiber within a sheath, e.g., an insulation covering or a protective outer jacket. Typically, a cable is two or more wires or optical fibers bound together, typically in a common insulation covering and/or protective jacket. The individual wires or fibers inside the sheath may be bare, covered or insulated. Combination cables may contain both electrical wires and optical fibers. The cable can be designed for low, medium, and/or high voltage applications. Typical cable designs are illustrated in U.S. Pat. Nos. 5,246,783, 6,496,629 and 6,714,707.

"Conductor" denotes one or more wire(s) or fiber(s) for conducting heat, light, and/or electricity. The conductor may be a single-wire/fiber or a multi-wire/fiber and may be in strand form or in tubular form. Non-limiting examples of suitable conductors include metals such as silver, gold, copper, carbon, and aluminum. The conductor may also be optical fiber made from either glass or plastic.

"Polymer" means a macromolecular compound prepared by reacting (i.e., polymerizing) monomers of the same or different type. "Polymer" includes homopolymers and interpolymers.

"Interpolymer" means a polymer prepared by the polymerization of at least two different monomers. This generic term includes copolymers, usually employed to refer to polymers prepared from two different monomers, and polymers prepared from more than two different monomers, e.g., terpolymers (three different monomers), tetrapolymers (four different monomers), etc.

Test Methods

Density

Density is determined according to ASTM D792, method B, on samples as prepared under ASTM D1928. Density measurements are made within one hour of sample pressing.

Melt Index

Melt index ($I_2$), is measured in accordance by ASTM D1238, condition 190° C./2.16 kg, and is reported in grams eluted per 10 minutes. $I_{10}$ is measured in accordance with ASTM D1238, condition 190° C./10.16 kg, and is reported in grams eluted per 10 minutes.

Wet Aging

Figure 4:
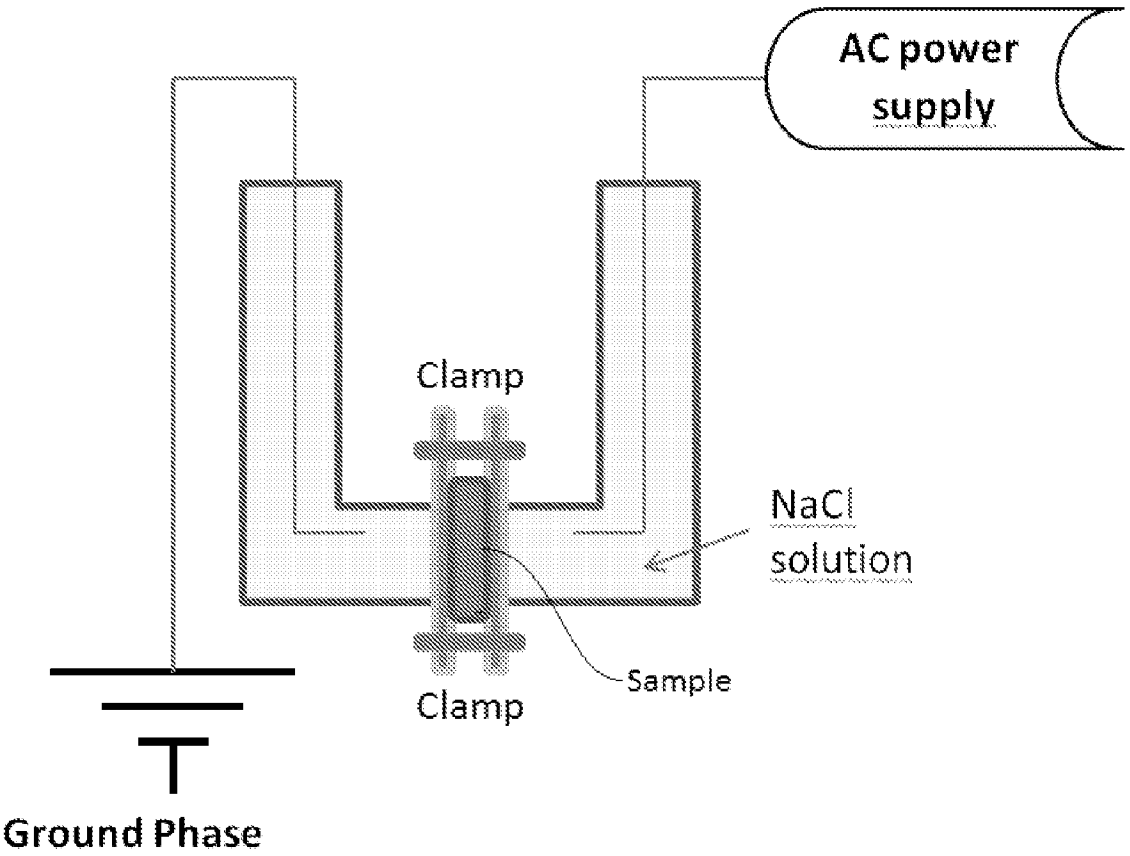
FIG. 4 is a schematic of a U-tube apparatus employed for wet electrical aging.

Insert a circular 2-inch diameter×40 mils plaque into a U-tube apparatus containing NaCl solution (either 0.01, 1.0, or 3.5 as described below) using clamps to maintain the plaque's position (see FIG. 4). Connect sample plaque to a 6 kV alternating current ("AC") power source. Age sample plaque under this condition for 21 days (504 hours).

Dielectric Breakdown

Dielectric breakdown strength is determined according to ASTM D149-09.

EXAMPLES

Example 1

Wet Aged Electrical Breakdown

The materials employed in the following examples are as follows. The low density polyethylene ("LDPE") is DXM-446, commercially available from The Dow Chemical Company, having a density of 0.92 g/cm$^3$, a melting point of 108° C., and a melt index ($I_2$) of about 2.1. The block composite 1 is an isotactic polypropylene/ethylene-propylene composition ("iPP-EP") (40/60 w/w ethylene-propylene to isotactic polypropylene; 65 wt % ethylene in ethylene-propylene block). The block composite 2 is an isotactic polypropylene/ethylene-propylene composition ("iPP-EP") (20/80 w/w ethylene-propylene to isotactic polypropylene; 65 wt % ethylene in ethylene-propylene block).

Block Composite Preparation

Catalyst-1 ([[rel-2',2'''-[(1R,2R)-1,2-cyclohexanediylbis(methyleneoxy-κO)]bis[3-(9H-carbazol-9-yl)-5-methyl[1,1'-biphenyl]-2-olato-κO]](2-)]dimethyl-hafnium) and cocatalyst-1, a mixture of methyldi($C_{14-18}$ alkyl)ammonium salts of tetrakis(pentafluorophenyl)borate, prepared by reaction of a long chain trialkylamine (Armeen™ M2HT, available from Akzo-Nobel, Inc.), HCl and Li[B($C_6F_5$)$_4$], substantially as disclosed in U.S. Pat. No. 5,919,983, Ex. 2., are purchased from Boulder Scientific and used without further purification.

CSA-1 (diethylzinc or DEZ) and cocatalyst-2 (modified methylalumoxane ("MMAO")) are purchased from Akzo Nobel and used without further purification. The solvent for the polymerization reactions is a hydrocarbon mixture (ISOPAR®E) obtainable from ExxonMobil Chemical Company and purified through beds of 13-X molecular sieves prior to use.

The block composites are prepared using two continuous stirred tank reactors ("CSTR") connected in series. The first reactor is approximately 12 gallons in volume while the second reactor is approximately 26 gallons. Each reactor is hydraulically full and set to operate at steady state conditions. Monomers, solvent, hydrogen, catalyst-1, cocatalyst-1, cocatalyst-2 and CSA-1 are fed to the first reactor according to the process conditions outlined in Table 1. The first reactor contents as described in Table 1 flow to a second reactor in series. Additional monomers, solvent, hydrogen, catalyst-1, cocatalyst-1, and optionally, cocatalyst-2, are added to the second reactor.

TABLE 1

Block Composite Process Conditions

| | Block Composite 1 | | Block Composite 2 | |
|---|---|---|---|---|
| Condition | 1$^{st}$ Reactor | 2$^{nd}$ Reactor | 1$^{st}$ Reactor | 2$^{nd}$ Reactor |
| Reactor Control Temp. (° C.) | 95 | 93 | 95 | 100 |
| Solvent Feed (lb/hr) | 229 | 343 | 130 | 501 |
| Propylene Feed (lb/hr) | 8 | 32 | 4 | 46 |
| Ethylene Feed (lb/hr) | 13 | 0 | 8 | 0 |
| Reactor Propylene Conc. (g/L) | 2.12 | 4.27 | 2.19 | 2.93 |
| Hydrogen Feed (SCCM) | 13 | 11 | 13 | 21 |
| Catalyst Efficiency (gPoly/gM) * 10$^6$ | 8.76 | 0.45 | 5.53 | 0.13 |
| Catalyst Flow (lb/hr) | 0.24 | 1.10 | 0.41 | 1.78 |
| Catalyst Conc. (ppm) | 10 | 60 | 5 | 196 |
| Cocatalyst-1 Flow (lb/hr) | 0.09 | 0.66 | 0.65 | 1.75 |

TABLE 1-continued

Block Composite Process Conditions

| | Block Composite 1 | | Block Composite 2 | |
|---|---|---|---|---|
| Condition | 1$^{st}$ Reactor | 2$^{nd}$ Reactor | 1$^{st}$ Reactor | 2$^{nd}$ Reactor |
| Cocatalyst-1 Conc. (ppm) | 199 | 1000 | 29 | 2000 |
| Cocat.-2 Flow (lb/hr) | 0.28 | 0 | 0.17 | 0 |
| Cocat.-2 Conc. (ppm) | 1993 | 0 | 1993 | 0 |
| DEZ Flow (lb/hr) | 0.68 | 0 | 0.40 | 0 |
| DEZ Concentration (ppm) | 20000 | 0 | 20000 | 0 |

The block composites prepared as described above have the following properties shown in Table 2:

TABLE 2

Block Composite Properties

| Property | Block Composite 1 | Block Composite 2 |
|---|---|---|
| Melt Flow Rate ("MFR") (230° C./2.16 Kg) | 1.7 | 1.2 |
| Molecular Weight (Mw) (Kg/mol) | 169,420 | 305,250 |
| Polydispersity Index (Mw/Mn) | 3.03 | 4.81 |
| Total Weight Percent $C_2$ | 26.9 | 13.5 |
| Melting Temperature (° C.) Peak 1 | 134.11 | 140.50 |
| Crystallization Temperature (° C.) | 91.3 | 105.3 |
| Melt Enthalpy (J/g) | 66.89 | 72.07 |
| Wt % iPP | 58 | 81 |
| Wt % EP | 42 | 19 |
| Wt % $C_2$ in EP | 63 | 68 |
| Block Composite Index | 0.33 | 0.47 |

Using the block composites prepared as described above, prepare samples having the following compositions described in Table 3, below. The antioxidant employed is TBM6, a hindered thiobisphenol (CAS 99-69-5).

TABLE 3

Sample Compositions

| | Sample No.: | | | |
|---|---|---|---|---|
| | Comp. 1 | 2 | 3 | 4 |
| DXM 446 LDPE (wt %) | 99 | 0 | 69 | 39 |
| iPP-EP Block Composite 1 (wt %) | 0 | 99 | 30 | 60 |
| TBM6 Antioxidant (wt %) | 1 | 1 | 1 | 1 |
| Total: | 100 | 100 | 100 | 100 |

Prepare the samples illustrated in Table 3 by compounding the ingredients in a Brabender mixer using a 300 g mixing bowl at 180° C. for 15 minutes at 30 rpm. Prepare approximate 8 inch×8 inch×40 mils plaques from 40 g of each sample by mold pressing for 5 minutes at 2,000 psi at 120° C., for 25 minutes at 25 tons at 180° C., and for 10 minutes at 25 tons while cooling to ambient. Cut samples into circular 2-inch diameter plaques for wet aging.

Test each sample (unaged) for dielectric breakdown as described by ASTM D149. Wet age each sample according to the procedure described above in 0.01 M and 1.0 M NaCl aqueous solutions, and test each wet aged sample for dielectric breakdown as described by ASTM D149. The results of these analyses are provided in FIGS. 1 and 2.

Figure 2:
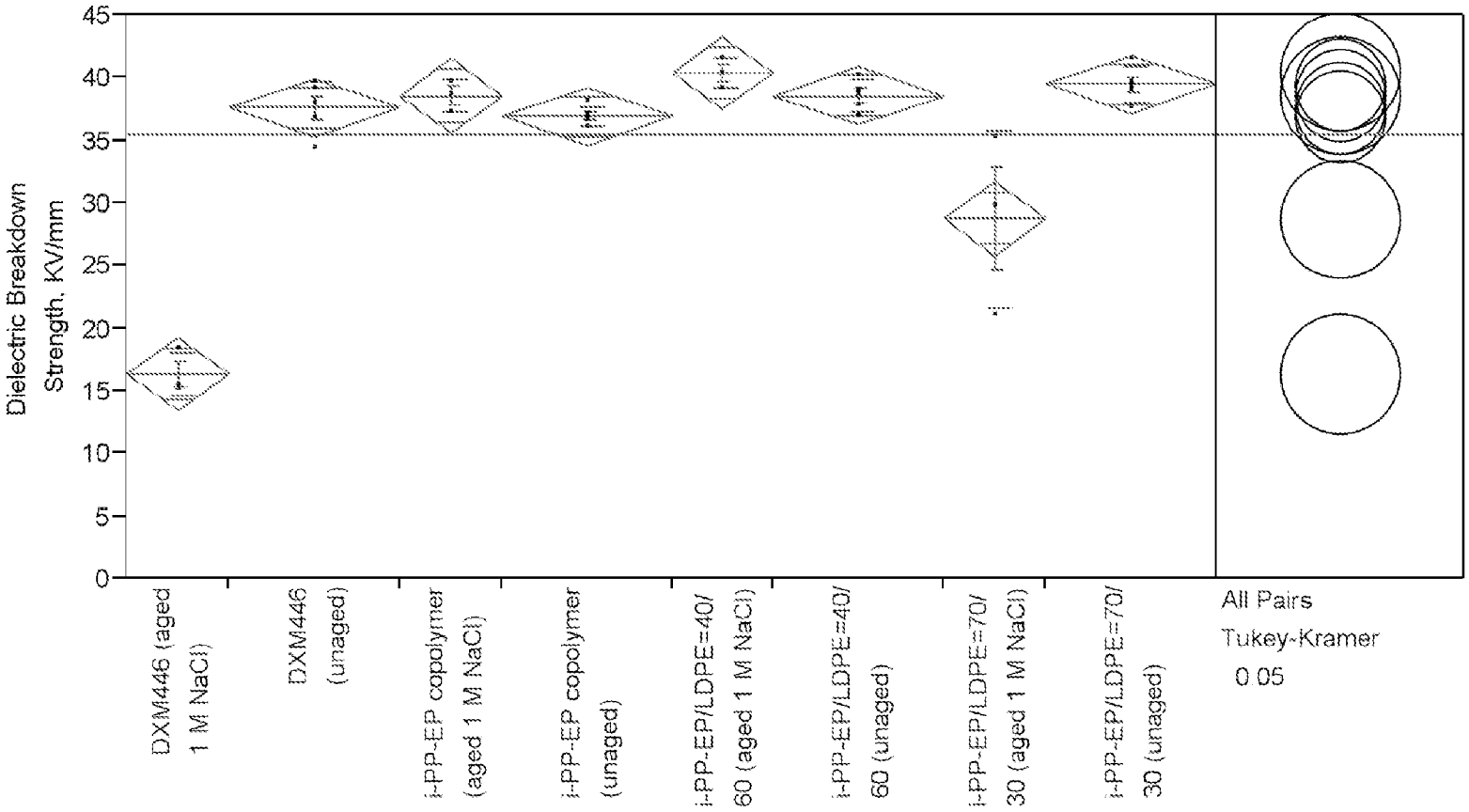
FIG. 2 is a chart of dielectric breakdown strength for samples prepared in Example 1, specifically dielectric breakdown performance before and after aging in 1.0 M NaCl.

FIGS. 1 and 2 demonstrate that the iPP-EP block composite by itself and its blend with LDPE can improve the wet aging of insulation compounds for power cable applications. At 0.01 M NaCl condition, the retention of dielectric breakdown strength of iPP-EP block composite well exceeds that of the comparative sample 1 (LDPE control). Similarly, at 1.0 M NaCl condition, the retention of dielectric breakdown strength of iPP-EP block composite well exceeds that of LDPE control.

Example 2

High Salinity Wet Aged Electrical Breakdown

In the following, HFDB-4202 is a tree-retardant cross-linked polyethylene ("TR-XLPE") commercially available from The Dow Chemical Company containing a tree retardant additive.

Prepare samples having the following compositions:

TABLE 4

Sample Compositions

| | Sample No.: | | | | | |
|---|---|---|---|---|---|---|
| | Comp. 5 | Comp. 6 | 7 | 8 | 9 | 10 |
| DXM 446 LDPE (wt %) | 99 | 0 | 0 | 0 | 39 | 39 |
| iPP-EP Block Composite 1 (wt %) | 0 | 0 | 99 | 0 | 60 | 0 |
| iPP-EP Block Composite 2 (wt %) | 0 | 0 | 0 | 99 | 0 | 60 |
| HFDB-4202 (wt %) | 0 | 99 | 0 | 0 | 0 | 0 |
| TBM6 Antioxidant (wt %) | 1 | 1 | 1 | 1 | 1 | 1 |
| Total: | 100 | 100 | 100 | 100 | 100 | 100 |

Prepare the samples illustrated in Table 4 in the manner described in Example 1, above. Test each sample (unaged) for dielectric breakdown as described by ASTM D149. Wet age each sample according to the procedure described above using a 3.5 M NaCl aqueous solution, and test each wet aged sample for dielectric breakdown as described by ASTM D149. The results of these analyses are provided in Table 5, below.

TABLE 5

High Salinity Wet Aged Electrical Breakdown

| Sample | Unaged Breakdown Strength (kV/mm) | 3.5M NaCl Wet Aged Breakdown Strength (kV/mm) | Decrease in Breakdown Strength | Breakdown Strength Retention |
|---|---|---|---|---|
| Comp. Ex. 5 | 37.6 | 22.2 | 41% | 59% |
| Comp. Ex. 6 | 39.8 | 35.1 | 12% | 88% |
| Ex. 7 | 37.0 | 36.1 | 2% | 98% |
| Ex. 8 | 37.2 | 33.7 | 9% | 91% |
| Ex. 9 | 38.5 | 37.1 | 4% | 96% |
| Ex. 10 | 39.3 | 38.1 | 3% | 97% |

Table 5 demonstrates that the iPP-EP block copolymer by itself and its blend with LDPE can improve the dielectric breakdown strength retention after wet aging of insulation compounds for power cable applications, even in the absence of a tree retardant additive and under very high salinity conditions. The retention of dielectric breakdown strength of the iPP-EP block copolymer by itself as well as its blends with LDPE is about the same or higher compared to the TR-XLPE, and significantly higher than the LDPE.

Example 3

Density

Determine the density of each sample as prepared in Example 2 according to the procedure described above. Results are provided in Table 6, below:

TABLE 6

Density

| Sample | Density (g/cm$^3$) |
|---|---|
| Comp. Ex. 5 | 0.92 |
| Comp. Ex. 6 | 0.92 |
| Ex. 7 | 0.88 |
| Ex. 8 | 0.89 |
| Ex. 9 | 0.90 |
| Ex. 10 | 0.90 |

As the density of the base resin decreases, it becomes more flexible. The lower density of Examples 7-10 can aid in cable installation due to increased flexibility of the insulation.

Example 4

Viscoelasticity

Determine loss modulus (G") and elastic modulus (G') of samples Comp. 5 and 7-10 as prepared in Example 2. Measure melt rheological properties with a dynamic rheometer (TA Instrument). Employ a 2 percent strain at the range of frequency from 0.01 to 10 $s^{-1}$ at 140° C.

Figure 3:
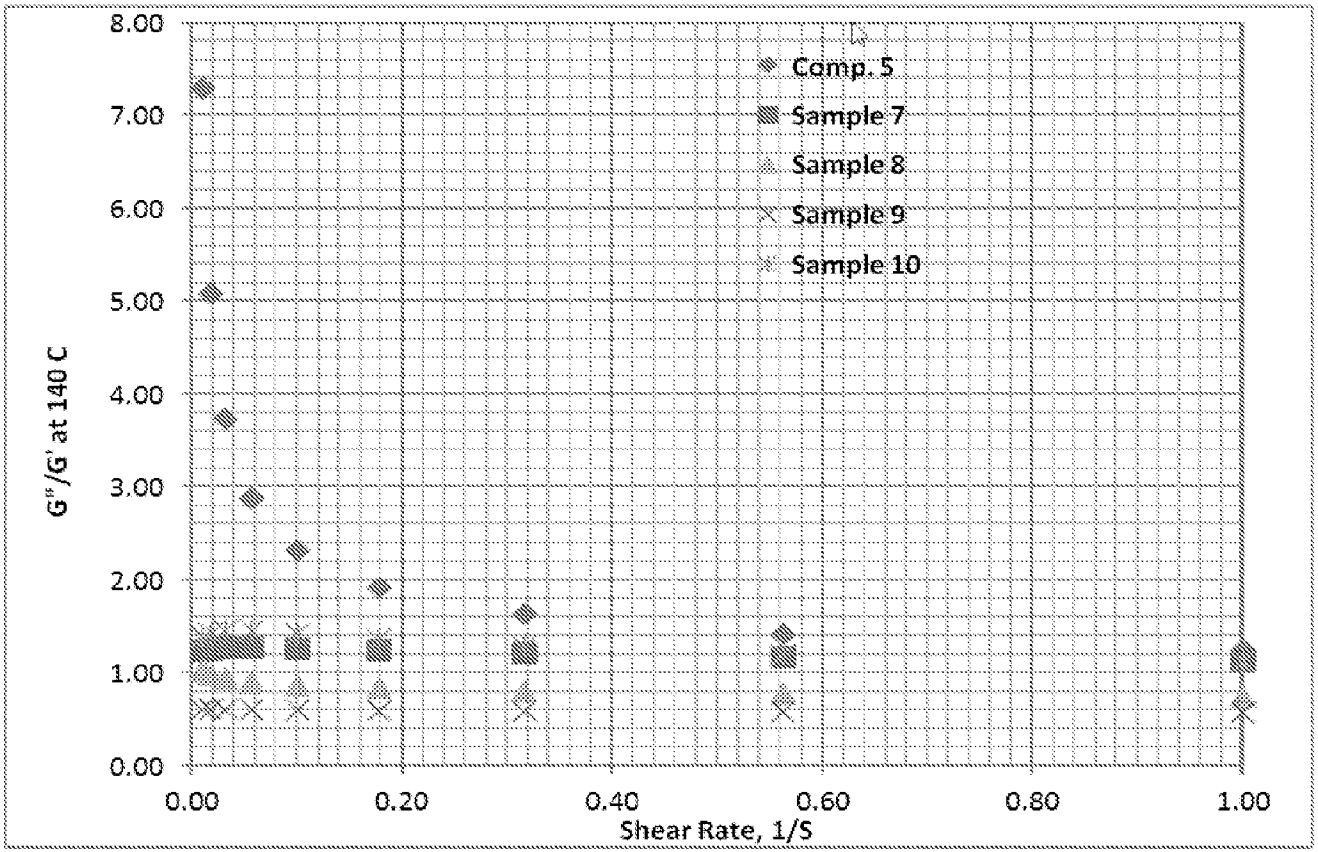
FIG. 3 is a graph of rheological dissipation factor (G"/G') versus shear rate 1/s for samples prepared in Example 2.

Results of this analysis are shown in FIG. 3. The blends of block composite and LDPE demonstrated lower rheological dissipation factor in broad shear rate than LDPE alone, indicating more solid-like elastic response to stress-induced energy than liquid-like viscous behavior. It also suggests the effective dynamic mechanical damping behavior over a broad range of the tested shear rates, which may be attributed to the unique phase morphology. The solid-like response also indicates enhanced dimensional stability at elevated temperature conditions in cables and fabricated insulation parts, and the ability to withstand the electrical resistance on electromechanical breakdown stress.

The invention claimed is:

1. A coated conductor comprising:

a conductive core; and a polymeric coating at least partially surrounding said conductive core, wherein said polymeric coating comprises an α-olefin based polymer and an α-olefin block composite;

wherein the α-olefin block composite comprises a soft copolymer, a hard polymer and a block copolymer having a soft segment and a hard segment, where the hard segment of the block copolymer is the same composition as the hard polymer in the block composite and the soft segment of the block copolymer is the same composition as the soft copolymer of the block composite, wherein the α-olefin block composite is prepared solely or substantially solely from two or more α-olefin types of monomers.

2. The coated conductor of claim 1, wherein said α-olefin block composite comprises diblock copolymers having hard polypropylene segments and soft ethylene-propylene segments.

3. The coated conductor of claim 2, wherein said polypropylene segments are highly isotactic.

4. The coated conductor of claim 2, wherein said α-olefin block composite comprises said polypropylene segments in an amount ranging from 10 to 90 weight percent based on the combined weight of said polypropylene segments and said ethylene-propylene segments, wherein said α-olefin block composite comprises said ethylene-propylene segments in an amount ranging from 10 to 90 weight percent based on the combined weight of said polypropylene segments and said ethylene-propylene segments.

5. The coated conductor of claim 2, wherein said ethylene-propylene segments comprise ethylene in an amount ranging from 35 to 70 weight percent, based on the entire weight of said ethylene-propylene segments.

6. The coated conductor of claim 1, wherein said α-olefin block composite has a block composite index of at least 0.10.

7. The coated conductor of claim 1, wherein said α-olefin based polymer is a low density polyethylene.

8. The coated conductor of claim 1, wherein said α-olefin based polymer is present in said polymeric coating in an amount ranging from 30 to 70 weight percent based on the combined weight of said α-olefin based polymer and said α-olefin block composite, wherein said α-olefin block composite is present in said polymeric coating in an amount ranging from 30 to 70 weight percent based on the combined weight of said α-olefin based polymer and said α-olefin block composite.

9. The coated conductor of claim 1, wherein said polymeric coating has dielectric breakdown retention of at least 70% as determined upon wet aging for 21 days in 3.5 M sodium chloride aqueous solution at a sample thickness of 40 mils by ASTM D149-09.

10. The coated conductor of claim 1, wherein said polymeric coating comprises substantially no polyethylene glycol.

* * * * *